US005966074A

United States Patent [19]

Baxter

[11] Patent Number: 5,966,074

[45] Date of Patent: Oct. 12, 1999

[54] INTRUDER ALARM WITH TRAJECTORY DISPLAY

[76] Inventor: Keith M. Baxter, 20850 MacAulay Dr., Brookfield, Wis. 53045

[21] Appl. No.: 08/991,146

[22] Filed: Dec. 16, 1997

Related U.S. Application Data

[60] Provisional application No. 60/033,021, Dec. 17, 1996.

[51] Int. Cl.[6] ..... G08B 13/00

[52] U.S. Cl. ..... 340/565; 340/541; 348/157; 348/159; 348/169; 702/150

[58] Field of Search ..... 340/565, 552, 340/541, 556, 557; 348/144, 157, 169, 172, 159; 702/150, 151, 152

[56] References Cited

U.S. PATENT DOCUMENTS

| | | | |
|---|---|---|---|
| 4,962,473 | 10/1990 | Crain | 340/541 |
| 5,280,530 | 1/1994 | Trew et al. | 348/169 |
| 5,513,854 | 5/1996 | Daver | 348/159 |
| 5,652,567 | 7/1997 | Traxler | 340/565 |
| 5,689,235 | 11/1997 | Sugimoto et al. | 340/541 |
| 5,731,997 | 3/1998 | Manson et al. | 702/150 |
| 5,764,283 | 6/1998 | Pingali et al. | 348/169 |
| 5,768,151 | 6/1998 | Lowy et al. | 348/157 |
| 5,822,077 | 10/1998 | Sasaki et al. | 340/541 |

*Primary Examiner*—Daniel J. Wu
*Assistant Examiner*—John Tweel, Jr.
*Attorney, Agent, or Firm*—Quarles & Brady

[57] ABSTRACT

Image data obtained from cameras or the like of a monitored are abstracted into a set of trajectories which may be displayed and used for referencing images or activating alarms based on trajectory location, angle or speed.

14 Claims, 4 Drawing Sheets

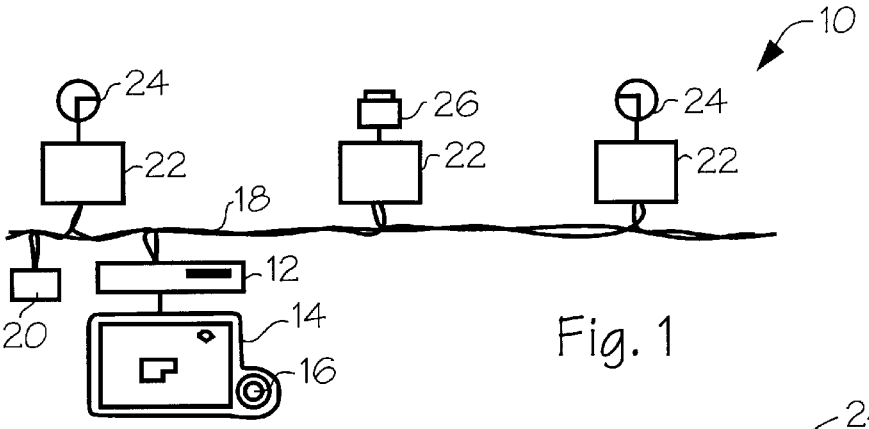
Fig. 1
Fig. 2a
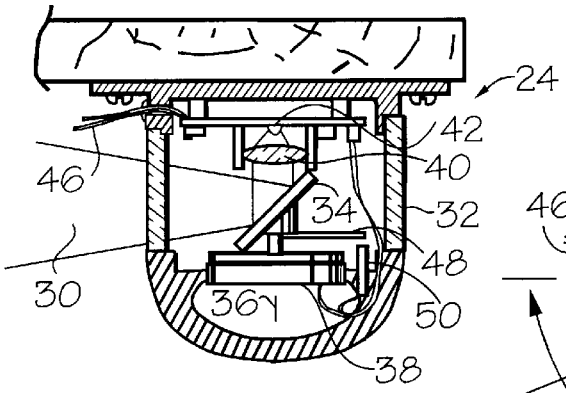
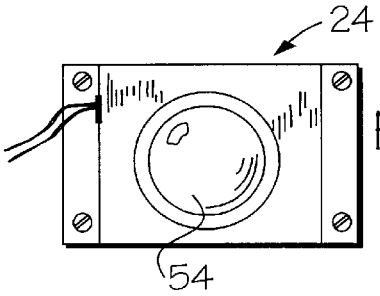
Fig. 3a
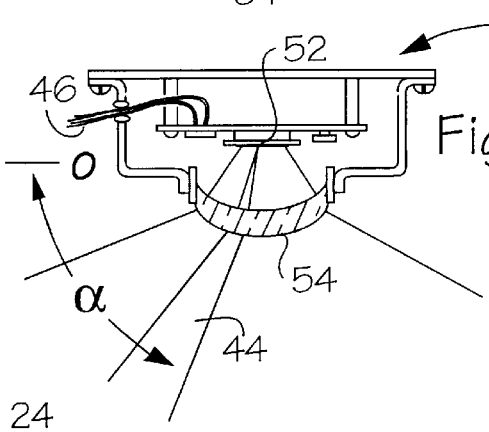
Fig. 3b
Fig. 2b
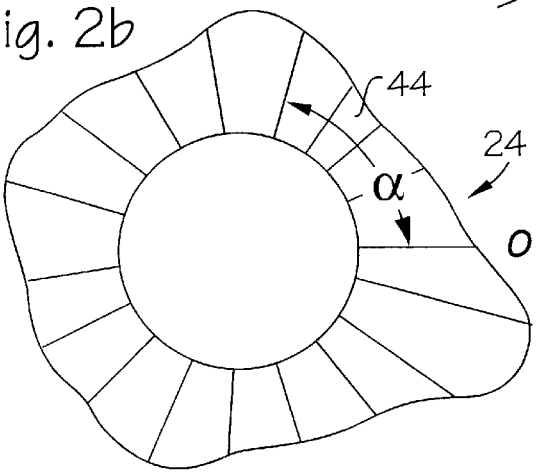

| | | |
|---|---|---|
| time 1 | $x_1$ | $y_1$ |
| time 2 | $x_2$ | $y_2$ |
| time 3 | $x_3$ | $y_2$ |
| time 4 | $x_3$ | $y_3$ |
| time 5 | $x_3$ | $y_3$ |
| time 6 | $x_3$ | $y_3$ |
| time 7 | $x_4$ | $y_4$ |
| time 8 | $x_4$ | $y_5$ |
| time 9 | $x_6$ | $y_6$ |

INTRUDER ALARM WITH TRAJECTORY DISPLAY

CROSS REFERENCE TO RELATED APPLICATIONS

This application claims the benefit of provisional application Ser. No. 60/033,021 filed Dec. 17, 1996.

The present invention relates generally to the field of intruder alarms and in particular to an alarm providing a simple and intuitive summary of activity in a protected area.

BACKGROUND OF THE INVENTION

A common means of monitoring an area is through the use of one or more closed circuit television cameras. These cameras may be connected to one or more video monitors, or a single video monitor providing a split screen function, which monitors may be observed by security personnel. The cost of having security personnel to monitor the images produced by the cameras is substantial. Further the tedium of the monitoring television images may make such monitoring unreliable.

It is known to connect the outputs of such closed circuit cameras to a video tape recorder in addition to or in lieu of providing the television signals to video monitors. Long duration video recorders using time lapse techniques can record several days worth of video input. This approach, however, provide no alarm signal but simply a record of the intrusion. If the time of the intrusion is not known, one or more videotapes must be manually reviewed, a time consuming process.

In order to minimize the recording of unimportant information, a motion sensitive video tape system may be employed where the video tape recording is activated only when motion is detected either by the camera or a separate motion detector. Such motion sensitive systems reduce the amount of video tape which must be reviewed if an intrusion is subsequently discovered, but are ineffective in areas where constant motion is to be expected. The motion sensitive devices, when connected to an alarm, tend to produce false alarms.

BRIEF SUMMARY OF THE INVENTION

The present invention provides an intruder alarm system that records spatially localized motion within a protected area as a set of trajectories or paths through the protected area. This path data may be reviewed in a map-like display showing the various trajectories superimposed over a plan view of the protected area.

Specifically, the present invention includes at least one optical sensor providing a plurality of signals indicating received light at different angles across the protected area. A computer receiving the signals and their angles, and communicating with a display screen, operates according to a stored program to detect changes in the received signals to relate the changes in the received signals to at least one region within the protected area. The computer further to links the one region with other regions to describe at least one trajectory within the protected area of an object moving within the protected area. The computer displays the trajectory on a display screen.

Thus, it is one object of the invention to provide a simple way of summarizing activity in a protected region over a period of time.

The optical sensors may include at least two sensors providing a first and second set of signals and azimuthal angles.

Thus it is another object of the invention to provide the trajectory display using optical sensors that may be extremely sensitive. By limiting the optical system to an azimuthal scan, greater light sensitivity may be obtained and infrared sensitivity may also be obtained.

The optical sensors may be area-image acquiring cameras such as closed circuit television cameras. The trajectories may be stored together with time values indicating the time of occurrence of the underlying motion.

Thus it is another object of the invention to catalog large amount of data captured by closed circuit television systems in a compact form according to trajectories.

The trajectories may be used to trigger an alarm. In one embodiment, when the trajectory moves within a predefined zone an alarm is activated. In other embodiments, a particular angles of trajectory or speed of trajectory is also required.

Thus it is another object of the invention to provide an improved alarm thresholding system less prone to false alarms than conventional motion detecting equipment.

BRIEF DESCRIPTION OF THE SEVERAL VIEWS OF THE DRAWINGS

FIG. 1 is a schematic representation of an intruder alarm according to the present invention showing multiple optical sensors linked on a common communication link to a central computer and display screen;

FIG. 2*a* is an elevational cross-section of a first embodiment of one of the optical sensors of FIG. 1 employing a rotating scanning mirror and a single optical detector;

FIG. 2*b* is a plan view of the sensor of FIG. 2*a* showing a plurality of angular sectors in which presence sensing signals may be detected over a range of angles $\alpha$;

FIG. 3*a* is a plan view of a second embodiment of the optical sensor employing a wide-angle lens and linear photodiode array.

FIG. 3*b* is a cross-sectional plan view of the sensor of FIG. 3*a* showing a light path for different angular sectors from which presence sensing signals may be obtained at different angles alpha;

DETAILED DESCRIPTION OF THE INVENTION

Figure 4:
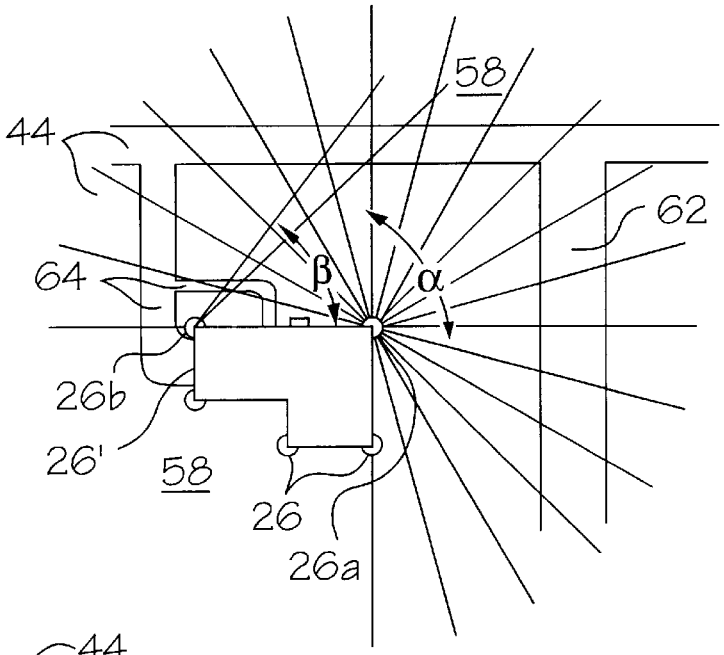
FIG. 4 is a plan view of a residence and surrounding streets showing the positioning of various optical sensors and showing a range of angular sectors corresponding to presence signals for one of the optical sensors and showing a single angular sector for a second optical sensor such as may establish triangulation of a moving object.

Referring now to FIG. 1 an intrusion detection system 10 of the present invention includes a central computer 12 of conventional microprocessor-based design attached to a display 14 display having a cursor control device 16 such as an integral track ball providing cursor control signals as are well understood in the art. As will be discussed further below, the display 14 provides a map or plan view of a protected area monitored by the intrusion detection system 10.

Also attached to the computer 12 is a communications link 18 which may be an inexpensive twisted pair including two data conductors and two power conductors. A independent power supply 20 provides power to the power conductors. The communications link may employ any number of protocols but preferably makes use of the CAN protocol specified in ISO document ISO/TC22/SC3/WG1 as authored by Robert Bosch GmbH, hereby incorporated by reference.

Attached at various points along the link 18 are transmitting stations 22 each attached to an optical detector 24 or camera 26 as will be described in more detail below. The transmitting stations receive image signals from the optical detectors 24 and camera 26 and format and compress those image signals for transmission to the computer 12. The transmitting stations 22 may be 80C592 microcontrollers preprogrammed for executing the CAN protocols and commercially available from Signetics Corporation having offices in Sunnyvale, Calif.

Generally, the image data received from the transmitting stations 22 is processed by the computer 12 to detect zones of motion which are linked over time to form trajectories that may be displayed on the display 14.

Referring now to FIGS. 2*a* and 2*b*, in a first embodiment, the optical detector 24 is a two-dimensional camera providing a measurement of received light over a plurality of azimuthal or horizontal angles $\alpha$. Light 30 emanating from a region to be protected by the intrusion detection system 10 passes through upright cylindrical and transparent wall 32 from over 360° of azimuthal angle. This light is received by a mirror 34 rotating about a vertical axis 36 as driven by a motor 38. Mirror 34 is tipped at 45° with respect to the vertical axis 36 to reflect light 30 from different angles $\alpha$ successively up to an imaging lens 40 that focuses the light on photosensitive element 42.

As mirror 34 rotates about vertical axis 36, light received from different angular sectors 44 at different angles $\alpha$ is measured by photosensitive element 42 to produce discrete electrical signals associated with each sector 44 which may be transmitted via wires 46 to the transmitting stations 22 and then to the computer 12. The photosensitive element 42 may operate in the visible infrared region with an appropriate selection of lens material and mirror material.

The speed of rotation of the motor 38 may be adjusted to change the effective sensitivity of the photosensitive element 42 to accommodate differences between day and night lighting. A synchronizing signal indicating the position of the mirror 34 and thus providing a reference from which a particular angular sector 44 may be identified, is provided by a vane 48 also attached to the motor 38 to rotate with the mirror 34. At each revolution of the motor 38, the vane 48 passes by a proximity switch 50 to provide a signal indicating the beginning of each scan.

Thus, the transmitting station 22 receiving a digitized version of the signal from the photosensitive element 42 and the reference signal from the proximity switch 50 transmits a series of detection signals indicating the amount of light received at each angular sectors 44 identified by angular sectors 44.

Referring now to FIGS. 3*a* and 3*b*, in a second embodiment, a linear photodiode array 52 is positioned behind a wide angle lens assembly 54 so that light from different angular sectors 44 received by the lens assembly 54 is focused to different photodiodes of the array 52. The detector array 52 may be scanned according to conventional techniques and the data read out along wires 46. The scanning speed may be changed to adjust the effective light sensitivity of the optical detector 24.

Referring now to FIG. 4, a monitored area 58 surrounding a residence 60 or the like may include streets 62 and driveways and walkways 64. Optical detectors 24 may be placed at corners of the residence 60 so as to receive light at a variety of angular sectors 44 covering from the monitored area 58.

In particular, a first optical sensor 26*a*, may receive a light signal from a plurality of angular sectors identified by angles $\alpha$ and a second light sensor 26*b*, may receive light from a plurality of angular sectors identified by angles $\beta$. As will be described below, changes in the presence signals received by sensors 26*a* and 26*b* can be used to triangulate the presence of moving objects within the monitored area 58.

Figure 5:
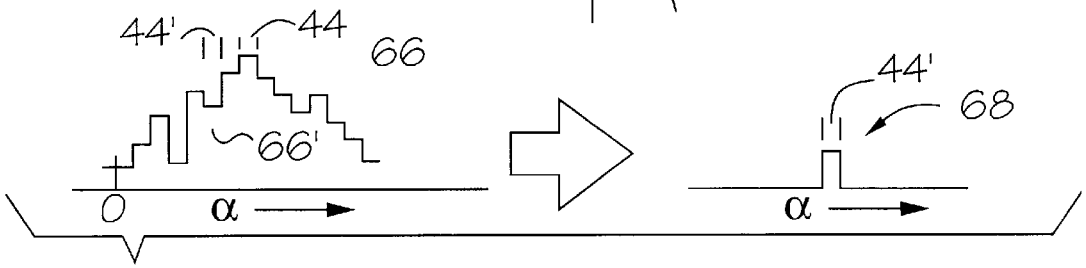
FIG. 5 is a graph of signal strength versus sector angle for the optical sensors of FIGS. 2 and 3 showing two successive scans having different presence signals for one angular sector and showing a compression of those signals indicating only changes in the presence sensing signals.

In this process and referring to FIG. 5, each optical detector 24 produces a set of raw presence signals 66 having amplitude as a function of an angle, for example $\alpha$. Generally, the raw presence signals 66 indicate the intensity of light signal received at a different angular sector 44 over the range of the optical detector 24. At different times, the set of raw presence signal 66 may change slightly as indicated by 66' representing a change in one presence signal for one particular angular sector 44'. Extracting the magnitude of a simple subtraction of the second set of raw presence signals 66' from the first set of raw presence signals 66 produces a compressed presence sensing signal 68. The arithmetic operation required by the compression may be performed by the transmitting stations 22 attached to each optical detector 24. The compressed presence sensing signal 68 has a lower information content, especially if only portions of the compressed signal exceeding a predetermined threshold are transmitted, and thus the compressed signal may be transmitted over a lower bandwidth link 18 using a twisted pair rather than, for example, coaxial cable thus simplifying installation.

Figure 6:
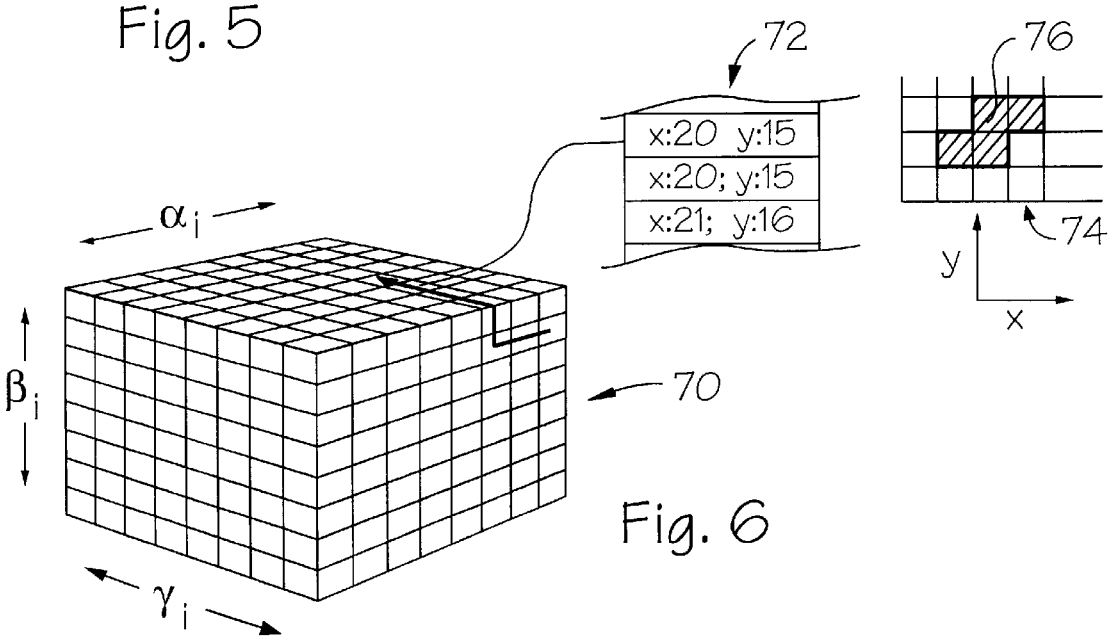
FIG. 6 is a schematic representation of the process of mapping changes in presence signals for different optical sensors to Cartesian coordinates such as may be displayed on the display of FIG. 1, the process being performed by the computer of FIG. 1.

Referring now to FIGS. 1, 4 and 6, the compressed presence sensing signal 68 indicating changes in the presence sensing signals may be sent from the transmitting stations 22 to the main computer 12 where the angular coordinates of the presence sensing signals about the different origins of their associated optical detectors 24 may be converted to a Cartesian coordinate system about a common origin. This conversion is done by a look-up table 70 having an arbitrary number of dimensions equal to the number of optical detectors 24. In this case, a look-up table 70 for three sensors (providing presence sensing signals having associated angles $\alpha_I$, $\beta_I$ and $\gamma_I$) is shown as a three dimensional array as would be realized in computer memory as a matrix data structure. The compressed presence sensing signal 68 of FIG. 5 for each optical detector 24 will have one or more non-zero values for particular angles $\alpha_I$, for example. This will be likewise true for the other optical detectors 24 for particular angles $\beta_I$ and $\gamma_I$. For each combination of these non-zero values, $\alpha_I$, $\beta_I$ and $\gamma_I$, the look-up table 70 will provide a unique set of Cartesian coordinate values 72. Generally, two different compressed presence sensing signal 68 will uniquely identify the location of a single object within the monitored area 58 and three different compressed presence sensing signals 68 will uniquely identify the locations of two different objects in the protected area. As will be described, because location information will be linked together in trajectories, ambiguity in the locating of objects in the monitored area 58 may often be resolved.

These Cartesian coordinate values of table 70 may be deduced geometrically from a plot of the locations of the optical detector 24 similar to that of FIG. 4 or may be derived empirically by causing motion at various points in the monitored area 58 at known Cartesian coordinate values and placing those known Cartesian coordinate values in the look-up table 70 at the locations indicated by the detected values $\alpha_I$, $\beta_I$ and $\gamma_I$. Additional values may be deduced by extrapolation from a sampling of values obtained empirically.

The amplitude values associated with each of the changed presence signals $\alpha_I$, $\beta_I$ and $\gamma_I$ are then averaged and placed in a Cartesian grid 74 comprised of pixels 76 as stored in computer memory. Grid 74 will indicate by its values of its constituent pixels the amount of change in the compressed presence sensing signals 68, and by the location of the values where the change occurred. For an individual moving within the monitored area 58 of FIG. 4, the grid 74 will produce an indication of the significance and location of that movement.

Figure 7:
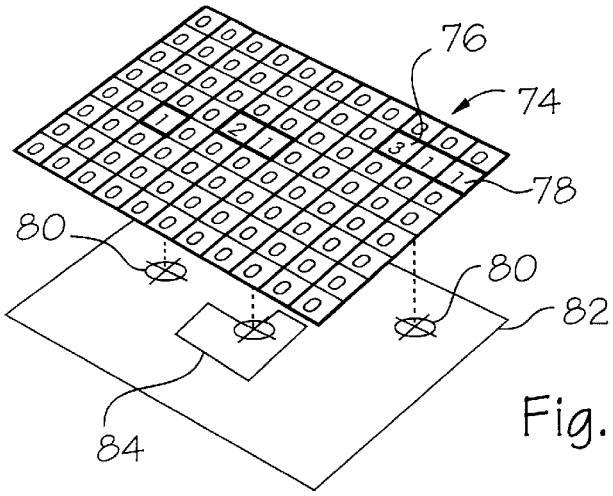
FIG. 7 is a schematic representation of the operation of the computer of FIG. 1 in identifying moving objects using a center of mass technique on the Cartesian coordinates developed in FIG. 6.

Referring now to FIG. 7, the Cartesian grid 74 is scanned to find grouped locations 78 having pixels with non-zero values indicating a change in the monitored area 58. This grouping of non-zero pixels may be done, for example, by a establishing a threshold value below which pixels are considered to be zero and finding groups of pixels unseparated by zero values. A center of mass of each such grouped location 78 is then determined to provide a center of mass location 80 on a picture plane 82 corresponding to an image of display 14. The picture plane 82 also has outlines 84 of particular visual landmarks within the monitored area 58 such as the residence, the sidewalks and trees and the like as may be prerecorded. Each center of mass location 80 has a single defined location and a value equal to the weighted average of the pixels 76 within the grouped locations 78 according to their distance from the center of mass location 80 ultimately computed. Typically, multiple center of mass locations 80 will be located on the picture planes 82 for any given pair of scans of the optical detector 24.

Figure 8:
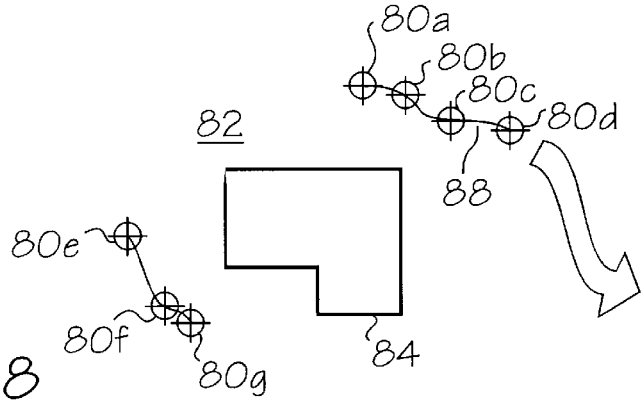
FIG. 8 is a schematic representation of the operation of the computer in linking adjacent centers of mass to trajectory threads stored in the memory of the computer and illustrating the simplification of the trajectory threads on an ongoing basis.

Referring now FIG. 8, as data is obtained over time from the optical detector 24, a series of center of mass locations 80*a*, 80*b*, 80*c* and 80*d* will be obtained from a moving object in the protected area together with center of mass locations 80*e*, 80*f* and 80*g* from a spatially second moving object. As each new center of mass location is computed, for example, 80*c* it is linked to the closest previous center of mass locations 80*b* to form a trajectory 88 stored in a trajectory thread list 90 providing a time value 92 together with x and y coordinate values 94 for that particular center of mass location. Center of mass location 80*f* measured at the same time, for example, as center of mass location 80*c* is not linked to the trajectory thread list 90 of center of mass location 80*c* because it is further from previous center of mass location 80*b* than 80C. Accordingly, center of mass location 80*f* is placed in a second trajectory thread list 90' and so multiple trajectory thread lists 90 may be simultaneously created.

Generally a new trajectory thread list 90 will be created when there are multiple center of mass locations 80 measured at any instant in time and will be ended when a center of mass location reaches an edge of a protected area as scanned by the optical detector 24 and then is no longer detected. For reasons of reducing storage requirements, multiple time entries within a trajectory thread list 90 having the same coordinate values are compressed to an earliest and latest value.

Often it will be the case that motion of an object within the monitored area 58 ceases and hence a center of mass location 80 disappears for a period of time. When motion occurs again and a new center of mass location 80 is detected, it is always compared against the last value of each of the threads then in existence to determine which trajectory thread list 90 it will be placed in.

Figure 11:
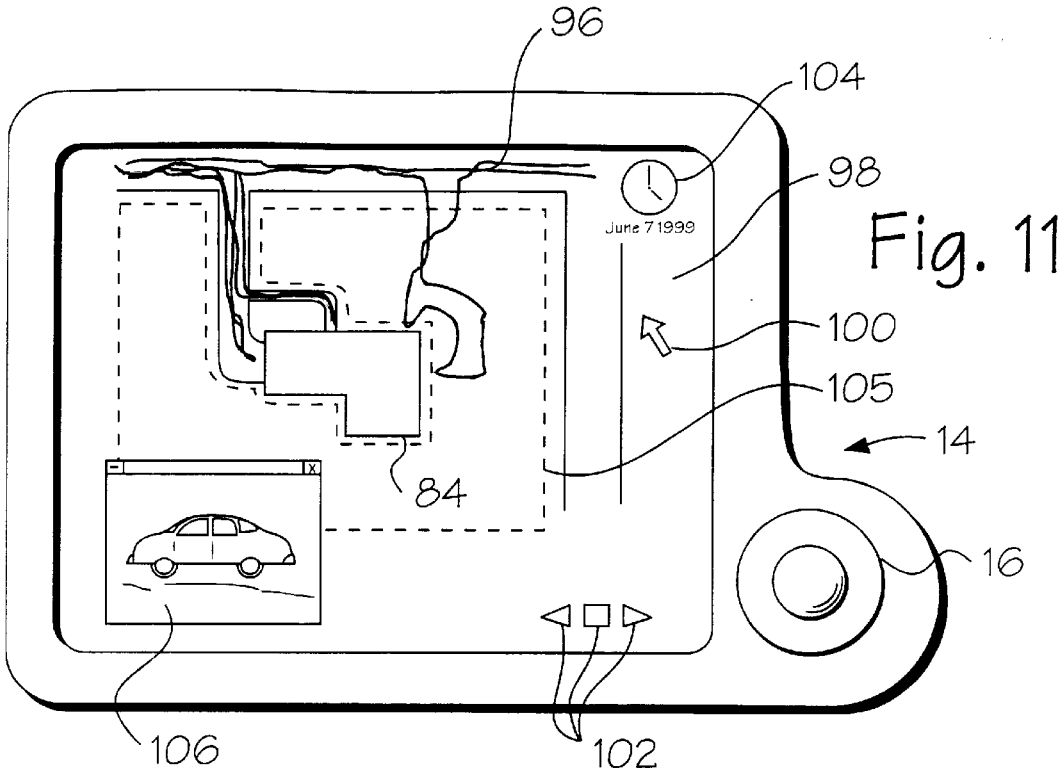
FIG. 11 is a detailed view of the display of FIG. 1 showing a representation of a residence and its surrounding streets and sidewalks having superimposed trajectories and alarm zones and having an inset of an image associated with a given trajectory.

Referring now to FIG. 11, each trajectory thread list 90 may be used to generate a set of tracks 96 on a top plan view 98 of the monitored area 58 of FIG. 4 as is displayed to the user of display 14. The tracks 96 displayed are for a predetermined time period, for example, twenty-four hours. The outlines 84 of landmark items such as the residence, pathways and roads may also be displayed on the display 14 as taken from the picture plane 82.

In reviewing this display, the user may manipulate a cursor 100 controlled by the cursor control device 16 to activate a set of play back buttons 102 which may be used to advance a pointer through the time values of the trajectory thread lists 90 changing the window in over which tracks 96 are developed. A display of a track 96 from the trajectory thread lists 90 close in time to the pointer may be highlighted or colored to differentiate it from those tracks 96 formed at a later time, in much the same fashion as actual tracks might disappear over time. In an alternative way of viewing the image on the display 14, the cursor 100 may be manipulated to a particular track 96 and a clock display 104 may display the time at which that track occurred as read from the trajectory thread list 90. The location of the cursor 100 may be matched to a track in the trajectory thread list 90 by searching through the coordinates in the trajectory thread list 90.

Referring again to FIG. 4, an area optical sensor 26' such as a CCD camera may also be placed near the residence 60 to view a portion or all of the monitored area 58. Image data may be periodically obtained from the camera 26' for particular times corresponding to times values of the clock display 104 so that the user may have an indication of what object created the particular track 96. Those images 106 may be displayed in a frame within the display 14. The number of images 106 obtained may be limited and stored on a magnetic disk storage device or the like or may be stored using a time lapse video recorder indexed to the trajectory thread list 90 by the common time values recorded with the images held by the time lapse recorder according to techniques known in the art.

Thus the virtual tracks 96 may provide an effective cataloging for much more voluminous image data of the monitored area 58.

The trajectory information of a trajectory thread list 90 may be used to steer or activate particular cameras 26' to obtain information representative of each track 96 over a wider area than that of a stationary camera 26'.

Figure 10:
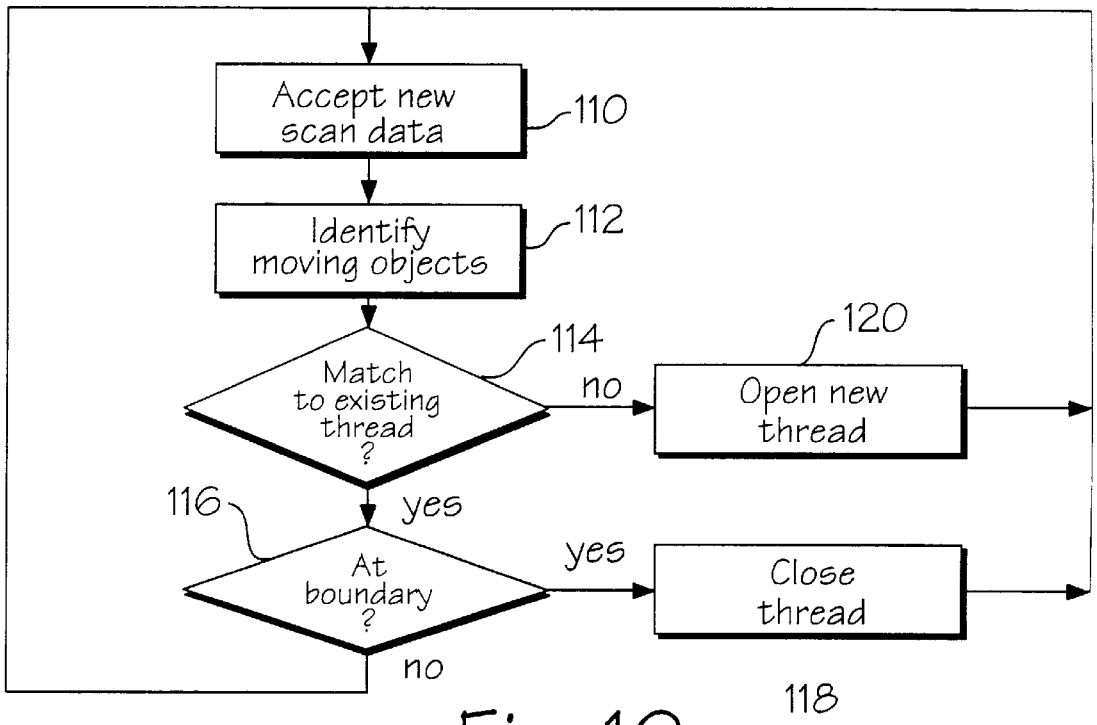
FIG. 10 is a flow chart of the software executed by the computer of FIG. 1 in converting presence sensing signals and angular data into trajectories.

Referring now to FIG. 10, the generation of the tracks 96 displayed on the display 14 is provided by a program operating on the computer 12. As indicated by process block 110 the program begins with the acceptance of new scan data from each optical detector 24 for a particular period in time. At process block 112, the scan data is compared with previous scan data to identify moving objects as indicated by the discussion associated with FIGS. 6 and 7. Each of these moving objects is compared to the existent thread lists at decision block 114. If a center of mass location 80 identified to a moving object may be matched to an existing thread of a trajectory thread list 90 (being within a predetermined threshold from the last thread value), then it is stored in the appropriate trajectory thread list 90 and the program proceeds to decision block 116.

At decision block 116, the center of mass location 80 is checked to determine whether the center of mass location 80 associated with the moving object is out of a boundary of the protected area 105. If it is not out of boundary, the program returns to process block 110. If it is out of boundary, the thread is closed as indicated by process block 118 and no longer used for the addition of new center of mass locations.

If at decision block 114 no existing thread may be associated with the particular center of mass location, then a new thread is opened at process block 120 and the program returns to process block 110.

Figure 9:
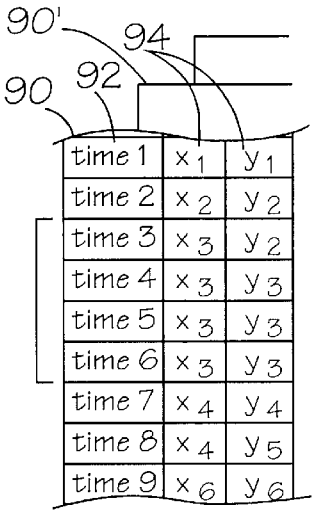
FIG. 9 is a schematic representation showing the use of an alternative embodiment of the optical sensing system such as a television camera to provide multiple angle presence sensing signals for use in the process of FIG. 6.
Figure 9:
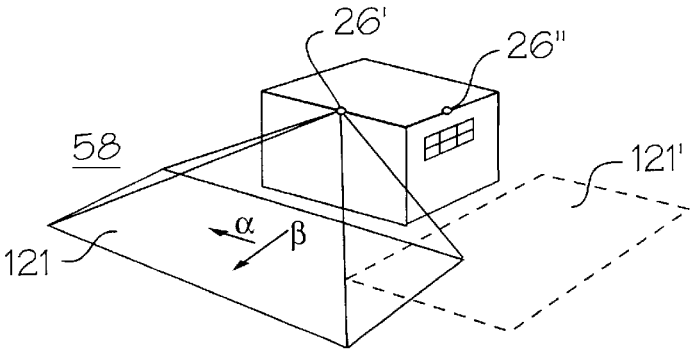

The use of scanning type two dimensional image sensors discussed with respect to FIGS. 2 and 3 presently provides important cost reduction and the ability to produce high sensitivity infrared and low light scanning systems. Nevertheless, in an alternate embodiment as indicated in FIG. 9, image type sensors 26' such as those used to capture images of objects moving within the monitored area 58 may be used to simultaneously obtain presence sensing signals in two angles $\alpha$ and $\beta$ and thus to uniquely identify moving objects. The center of mass of the moving objects can then be extracted into trajectories according to the present invention.

In FIG. 9, an elevated camera 26' is placed to view an area portion 121 of the monitored area 58. Other cameras 26" may view second areas 121' overlapping in part with the area 121 until the entire monitored area 58 is covered by at least one camera 26. Here the cameras 26 serve as the optical detectors described above. Ideally, such cameras 26' are conventional closed circuit TV cameras having wide angle lenses to maximize their aerial coverage. In this case, the look-up table 70 described with respect to FIG. 6, uses two angles $\alpha$ and $\beta$ describing the aerial coordinates of the imaged area of the camera 26' and serves mostly to correct for spatial distortion caused by the wide angle lens and the oblique imaging by the camera 26' of the area 121 from its elevated location. In all other respects, the trajectory information extracted is the same with the improvement that multiple imaged objects can be resolved and extinguished without ambiguity as a result of the raised vantage point of the cameras 26' and 26".

Referring again to FIG. 11, the user may use the cursor control device 16 to trace protected area 105 out on the top plan view 98. Movement of the tracks 96 into this protected area 105 may be used to activate an alarm or to trigger the obtaining of image data from a camera or the like. Complex alarm activation routines are made possible by the trajectory information including those which, for example, provide multiple protected areas 105 and set an alarm if the zones are crossed in a particular order within a particular time frame. Alternatively, the tracks 96 moving to within a protected area 105 and having a particular angle may be used to set the alarm or activate a picture taking based on the assumption that minor incursions not directed toward a central location may be false alarms. The speed of the trajectory also implicit in the trajectory thread list 90 may be used to set an alarm as speed may often be an indication of intent. High speeds within a particular protected area 105 may, for example, set off an alarm or low speeds of traffic or the like on a nearby road may be used to set the alarm. Deduction of speed and distance from the trajectory data of the trajectory thread list 90 is a simple mathematical process well understood to those of ordinary skill in the art.

The ability to distinguish trajectories and velocities within different protected areas 105 also allows different responses to incursions to be adopted. A voice alarm announcing a visitor may be used for incursions associated with times, zones and trajectories that suggest visitors whereas loud warning sirens or the like may be activated at different times, zones and trajectories that suggest vandals or thieves.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

I claim:

1. An intruder alarm for a monitored area comprising:

(a) at least one optical sensor providing a plurality of signals indicating received light at different angles across the monitored area;

(b) a display screen; and (c) an electronic computer receiving the plurality of presence signals and their angles and communicating with the display screen to operate according to a stored program to:

(i) detect changes in the received signals;

(ii) relate changes in the received signals to at least one region within the monitored area;

(iii) link the one region to other regions to describe at least one trajectories within the monitored area of an object moving within the monitored area; and (iv) display the trajectory on the display screen.

2. The alarm system as recited in claim 1 wherein there are at least two sensors providing a first set and second set of presence signals at azimuthal angles.

3. The alarm system as recited in claim 1 wherein the electronic computer further compares the trajectories against alarm zones of particular regions and if the trajectory crosses into the alarm zone provides an alarm to a user.

4. The alarm system as recited in claim 3 wherein the electronic computer further compares the trajectories against alarm angles and if the trajectory crosses into the alarm zone and is at substantially the alarm angle, provides an alarm to a user.

5. The alarm system as recited in claim 3 wherein the electronic computer further compares the trajectories against alarm velocities and if the trajectory crosses into the alarm zone provides at an alarm velocity provides an alarm to the user.

6. The alarm system as recited in claim 1 wherein the alarm system includes a cursor control device, and wherein the alarm regions are entered into the electronic computer by being drawn by the user on the display screen with the user using the cursor control device.

7. The alarm system as recited in claim 1 wherein the electronic computer further displays the display screen outlines of landmark objects of the group consisting of: buildings, vegetation, roads and sidewalks.

8. The alarm system as recited in claim 1 wherein the alarm system includes a cursor control device and wherein the electronic computer further displays on the display screen a clock face indicting a time at which the received signals of the trajectory were detected when the trajectory as displayed in selected by the cursor control device.

9. The alarm system as recited in claim 1 wherein the electronic computer sequentially displays the trajectory on the display screen in accelerated time sequence with other trajectories according to when received signals of the trajectories were detected.

10. The alarm system as recited in claim 1 wherein the electronic computer displays the trajectory on the display screen with other trajectories using different visual trajectory lines according to when the received signals of the trajectories were detected.

11. The alarm system as recited in claim 1 wherein the optical sensors acquire one dimensional image information providing presence signals at azimuthal angles.

12. The alarm system as recited in claim 1 wherein the optical sensors area image acquiring cameras.

13. The alarm system as recited in claim 1 including an electronic camera for capturing an image of at least a portion of the monitored area and wherein the electronic computer operates to capture images of the portion of the monitored area linked to the trajectories.

14. The alarm system as recited in claim 1 including an electronic camera for capturing an image of at least a portion of the monitored area and wherein the electronic computer steers the electronic camera to capture images of objects within the monitored area according to the trajectories.

* * * * *